US007569783B2

(12) United States Patent
Burger et al.

(10) Patent No.: US 7,569,783 B2
(45) Date of Patent: Aug. 4, 2009

(54) LOW-PROFILE SWITCH WITH FLAT SPRING ACTUATING MECHANISM

(75) Inventors: Philip M. Burger, Olathe, KS (US); Paul Horner, Wootton Northampton (GB)

(73) Assignee: Burger & Brown Engineering, Inc., Grandview, MO (US)

( * ) Notice: Subject to any disclaimer, the term of this patent is extended or adjusted under 35 U.S.C. 154(b) by 99 days.

(21) Appl. No.: 11/677,467

(22) Filed: Feb. 21, 2007

(65) Prior Publication Data

US 2008/0197009 A1 Aug. 21, 2008

(51) Int. Cl.
*H01H 13/06* (2006.01)

(52) U.S. Cl. ..... 200/243; 200/250; 200/293; 200/295

(58) Field of Classification Search ..... 200/530–535, 200/302.1, 302.2, 523, 342, 329, 331, 341, 200/18, 520, 573, 276, 293, 295, 296
See application file for complete search history.

(56) References Cited

U.S. PATENT DOCUMENTS

| | | | | |
|---|---|---|---|---|
| 2,673,468 | A | 3/1954 | Immel et al. | |
| 2,679,559 | A | 5/1954 | Morris et al. | |
| 2,888,731 | A | 6/1959 | McElroy et al. | |
| 3,091,679 | A * | 5/1963 | Norden | 200/295 |
| 3,094,591 | A | 6/1963 | Hill | |
| 3,099,736 | A | 7/1963 | Wilcox | |
| 3,566,065 | A | 2/1971 | Davis | |
| 3,594,529 | A | 7/1971 | Cartwright | |
| 3,647,309 | A | 3/1972 | Thompson | |

(Continued)

FOREIGN PATENT DOCUMENTS

| | | |
|---|---|---|
| GB | 829965 | 3/1960 |

(Continued)

OTHER PUBLICATIONS

International Search Report mailed Jul. 15, 2008 for International Application No. PCT/US2008/051460 filed Jan. 18, 2008 which claims priority from the present application. See p. 3, Section C. "Documents Considered to be Relevant."

(Continued)

*Primary Examiner*—Renee Luebke
*Assistant Examiner*—Sean Kayes
(74) *Attorney, Agent, or Firm*—Erickson, Kernell, Derusseau & Kleypas, LLC

(57) ABSTRACT

A low profile limit switch utilizes a bowed spring actuator for advancing a bridge contact into and out of contact with a pair of terminal contacts to close and open the switch. The bridge contact is mounted on a glide on an end of the spring and formed from an insulating material. The terminal contacts are spring loaded and maintained in spaced apart and staggered relationship so that only one of the terminal contacts remains in contact with the bridge contact when it is retracted by the bowed spring. A mounting clip including a mounting flange and spaced apart spring loaded arms extending generally perpendicular to the mounting flange is used to mount the switch to a surface proximate an edge without having to obtain any significant amount of vertical clearance above the switch for bolting it to the surface.

17 Claims, 4 Drawing Sheets

U.S. PATENT DOCUMENTS

| | | | | |
|---|---|---|---|---|
| 3,825,809 | A | 7/1974 | Gatland | |
| 3,836,300 | A | 9/1974 | Farrell | |
| 4,295,017 | A | 10/1981 | Kashima et al. | |
| 4,307,271 | A | 12/1981 | Carli | |
| 4,488,024 | A | 12/1984 | Colgate | |
| 4,619,271 | A | 10/1986 | Burger et al. | |
| 4,628,166 | A * | 12/1986 | Bingo et al. | 200/302.1 |
| 5,168,982 | A | 12/1992 | Hakanen | |
| 5,446,252 | A | 8/1995 | Burger et al. | |
| 6,734,381 | B2 | 5/2004 | Mayo | |
| 6,982,392 | B1 * | 1/2006 | Burger | 200/302.1 |
| 2006/0131153 | A1 * | 6/2006 | Asada | 200/341 |

FOREIGN PATENT DOCUMENTS

| | | | |
|---|---|---|---|
| JP | 8017286 | | 1/1996 |
| JP | 11007860 | | 1/1999 |
| JP | 2003109455 | | 4/2003 |
| JP | 2005353545 | | 12/2005 |
| SU | 1594621 | A1 | 9/1990 |

OTHER PUBLICATIONS

Written Opinion of the International Searching Authority mailed Jul. 15, 2008 for International Application No. PCT/US2008/051460 filed Jan. 18, 2008 which claims priority from the present application. See p. 3, Section C. "Documents Considered to be Relevant." See in particular, Box No. IV "Lack of Unity of Invention" on p. 3 and Box No. V "Reasoned statement under Rule 43bis. 1(a)(i) . . . " beginning on p. 4.

* cited by examiner 55
52
33
73
65
74
56
53
69
28
34
59
70
51
24
66
60
25

33
48
39
7.
21
59
69
46
14
40
62
24
52
47
42
25
28
63
43
133
40
49
60
70
38
20
7.
34
44

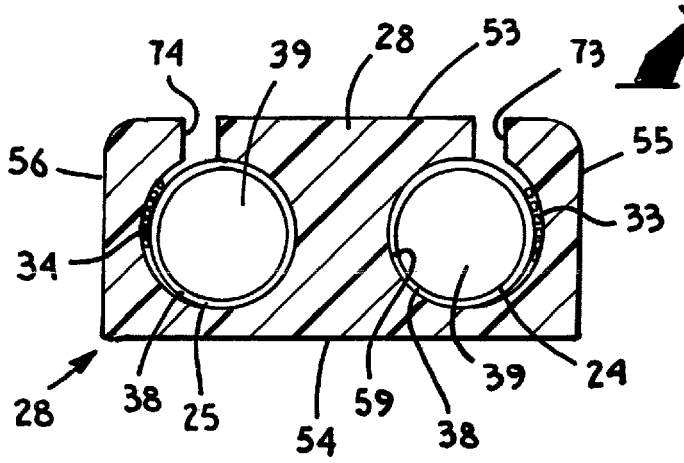
Fig. 7.
Fig. 8.
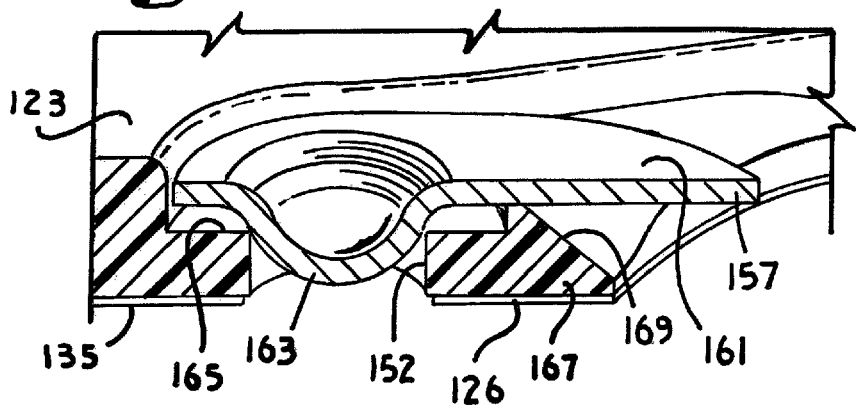

LOW-PROFILE SWITCH WITH FLAT SPRING ACTUATING MECHANISM

BACKGROUND OF THE INVENTION

The present invention relates to switches utilizing a bowed spring as an actuating mechanism.

In U.S. Pat. No. 5,446,252, issued Aug. 29, 1995, a switch assembly was disclosed utilizing a flat spring actuating mechanism formed from a bowed piece of spring steel for engaging the plunger of a plunger type switch. An improved, water resistant version is disclosed in U.S. Pat. No. 6,982,392. Commercial embodiments of these switch assemblies have been sold as the THINSWITCH® limit switch by Burger & Brown Engineering, Inc. The flat spring actuating mechanism is particularly well adapted for use with plunger type switches that are often referred to as micro-switches. In such micro-switches, the length or height of the switch (the dimension of the switch extending along the axis of the plunger) is generally considerably greater than the thickness of the switch. To minimize the thickness of the switch assembly, the micro switch is mounted on its side in a housing and the bowed spring is positioned in the housing so a first end abuts against the plunger with the middle portion of the spring extending up through a hole or slot in the housing. Pressing down on the middle portion of the spring causes the ends of the spring to move outward, driving the first end against the plunger and advancing the plunger a sufficient distance to change the condition of the switch. Upon removal of the external force acting on the spring, the spring returns to its original bowed state such that the first end of the spring advances away from the plunger and the plunger is allowed to move to the extended position changing the switch back to its original condition.

The switch assembly utilizing the flat spring actuating mechanism disclosed in U.S. Pat. No. 5,446,252 is particularly well adapted for use as a position sensing switch to sense when one portion of a piece of equipment is or is not positioned in a designated position. For example, a mold assembly for an injection mold utilizes ejector pins for ejecting the molded part out of the mold when mold halves of the mold assembly are separated. The ejector pins are typically mounted on an ejector plate that moves between extended and retracted positions relative to a respective mold half to advance the ejector pins into and out of the mold cavity formed in the mold half for ejecting the molded part from the mold assembly. It is important to ensure that the ejector pins are withdrawn from extending into the mold cavity before the two mold halves are brought together in the subsequent cycle for molding the next part. If the pins are not retracted they may be damaged upon closing of the mold.

The switch assembly of U.S. Pat. No. 5,446,252 is particularly well adapted for confirming that the ejector plate, and therefore the ejector pins, are fully retracted before closing the mold. When the ejector plate is fully retracted, low profile, cylindrical stops on an outer surface of the ejector plate abut against an interior wall of the mold assembly and more specifically an interior wall of the ejector housing. Alternatively, the stops may be mounted on the interior wall of the ejector housing. In most molds made in the United States, the height of the cylindrical stops is typically 3/16 of an inch or 0.1875 inches.

A preferred micro switch utilized in the THINSWITCH limit switch for the ejector plate application as described, is a subminiature basic switch No. 91SX39-T sold by the Micro Switch Division of Honeywell. This switch has a thickness of approximately 0.156 inches and is believed to be the thinnest micro switch having sufficient mechanical life and electrical rating for its intended application. At 0.156 inches, the 91SX39-T switch can be utilized in the switch assembly and fit within the gap of 0.1875 inches created by the stops on the ejector plate.

However, in molds manufactured in Europe and Asia, the stops are often only 3 millimeters (mm) or 0.118 inches tall, which is less than the thickness of the smallest commercially available micro-switch having sufficient life cycle and electrical rating for use as part of a limit switch assembly for mold ejection assemblies. Therefore, there remains a need for an even thinner yet rugged position sensing switch assembly which is particularly well adapted for industrial applications including use in association with injection molding machines.

There also remains a need for a better system for attaching the switch assembly of the type disclosed in U.S. Pat. No. 5,446,252 to an ejector housing of a mold assembly. Currently, the mold must be disassembled to provide sufficient access to the ejector housing to allow holes to be tapped therein so that the switch assembly housing may be screwed to the ejector housing.

SUMMARY OF THE INVENTION

The present invention comprises a low profile position sensing switch utilizing a bowed spring as an actuator and which may also be secured in place using a mounting clip with spring biased arms engaging a portion of the switch housing. The switch includes a pair of terminal contacts mounted in spaced apart relationship within the switch housing and in electrical contact with a pair of conductors from a power supply cable. A bridge contact is mounted on a first end of the bowed spring with a middle portion of the bowed spring extending above an upper surface of the housing. The bowed spring being positioned within said housing such that when the bowed spring is in a resting position, the bridge contact is positioned proximate said first and second terminal contacts with no more than one of the terminal contacts in contact with the bridge contact. Compression of the middle portion of the bowed spring downward advances the first end of the spring toward the terminal contacts and into engagement with both terminal contacts changing the condition of the switch from its normally open condition to a closed condition. Upon removal of the compressive force on the bowed spring the first spring end advances away from the terminal contacts a distance sufficient to advance the bridge contact out of engagement with at least one of the terminal contacts changing the condition back to open.

The terminal contacts preferably comprise spring probes having a plunger spring loaded within a cylindrical barrel. The terminal contacts are held in spaced relation in bores formed in a terminal connector block. The terminal connector block includes flexible sidewalls to accommodate insertion of the end of a conductor and a spring probe in each of the bores and compress the conductor against the spring probe. Stops formed in the connector block at the end of each bore are staggered such that one of the spring probes extends out of the connector block further than the other spring probe.

The mounting clip includes a mounting flange for attachment to an edge adjacent and perpendicular to a support surface to which the switch is to be mounted. Spring arms extend outward from the mounting bracket at an angle of approximately ninety degrees or slightly less relative to the mounting flange, such that the spring arms may angle slightly downward. Inwardly curved or directed detents are formed on distal ends of the spring arms with a dimple or boss projecting downward from each of the detents. Corresponding recesses are formed in the upper surface of ears or wings projecting outward from the main portion of the switch housing. The spring arms are spaced apart a distance generally corresponding to the width of the switch housing. The switch housing is slid between the arms until the bosses on the detents engage a leading ramp like edge of each wing. The bosses slide over the leading edge until the bosses advance over and then drop into the recesses such that the spring arms hold the switch against the surface to which it is mounted.

BRIEF DESCRIPTION OF THE DRAWINGS

FIG. 7 is an enlarged cross-sectional view of the terminal connector block with the terminal contacts and conductors secured therein and taken generally along line 7-7 of FIG. 6

FIG. 8 is an enlarged and fragmentary cross sectional view taken generally along line 8-8.

DETAILED DESCRIPTION OF THE PREFERRED EMBODIMENT

As required, detailed embodiments of the present invention are disclosed herein; however, it is to be understood that the disclosed embodiments are merely exemplary of the invention, which may be embodied in various forms. Therefore specific structural and functional details disclosed herein are not to be interpreted as limiting, but merely as a basis for the claims and as a representative basis for teaching one skilled in the art to variously employ the present invention in virtually any appropriately detailed structure.

Figure 1:
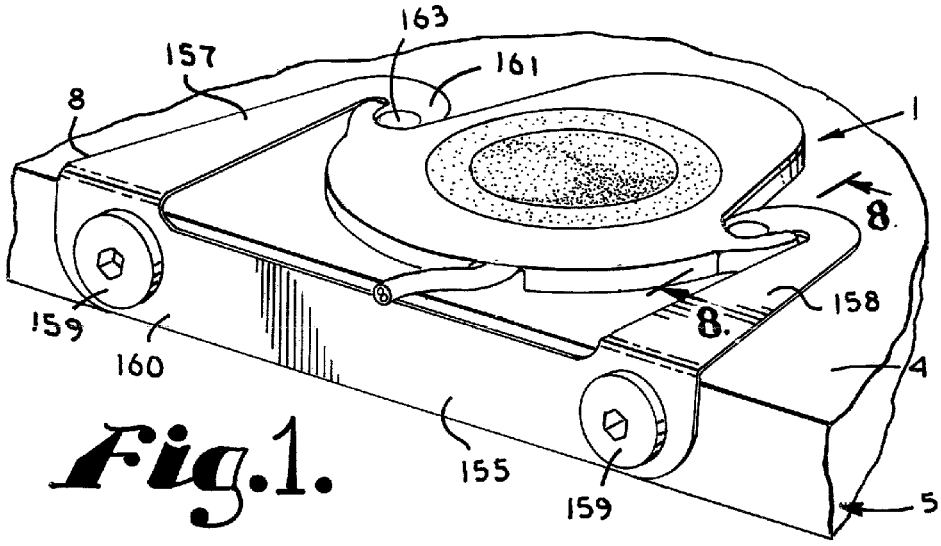
FIG. 1 is a fragmentary, perspective view of a limit switch assembly mounted on a surface of a mold ejector housing by a mounting clip.
Figure 2:
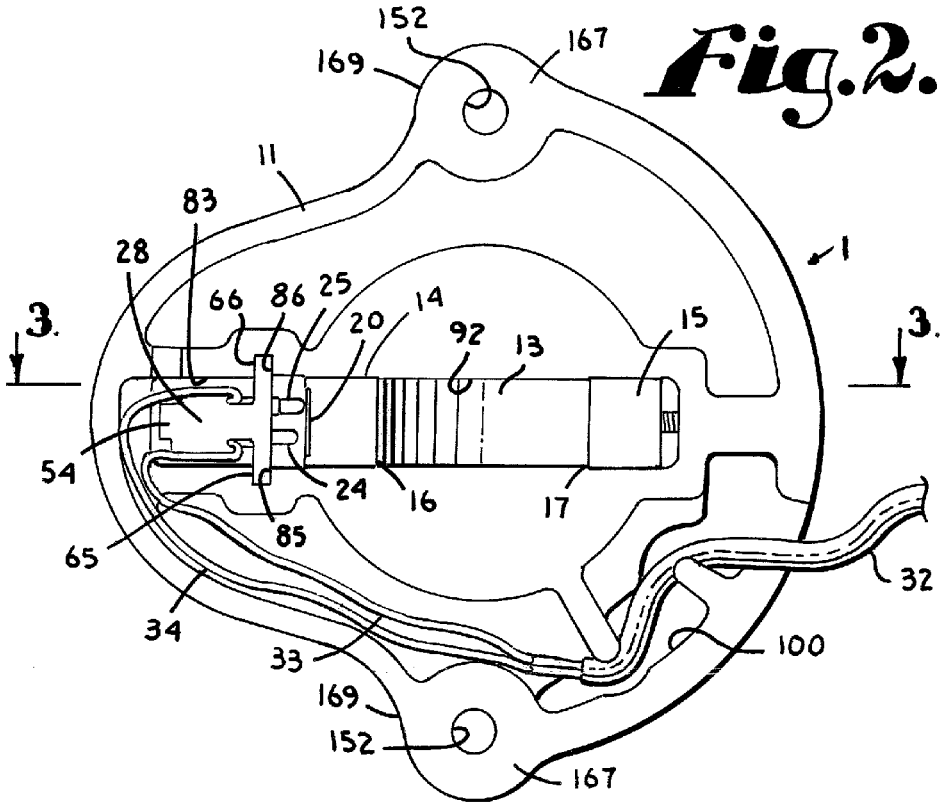
FIG. 2 is a bottom plan view of the limit switch assembly with a backing sheet removed to show detail thereof.
Figure 3:
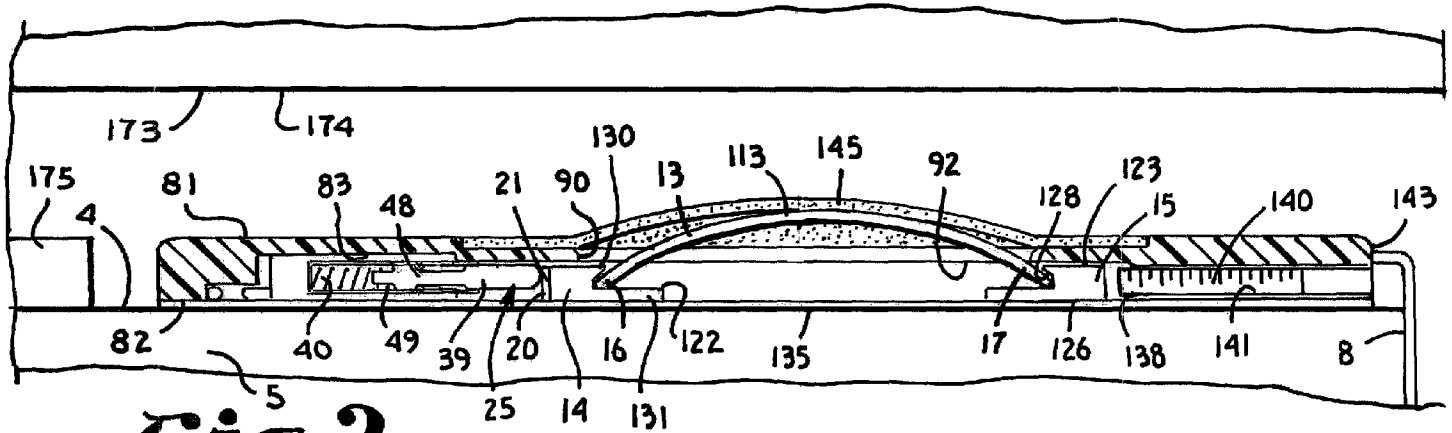
FIG. 3 is a cross-sectional view generally taken generally along line 3-3 of FIG. 2 and showing the limit switch assembly secured within an ejector plate assembly of an injection mold with the ejector plate in an extended position.
Figure 4:
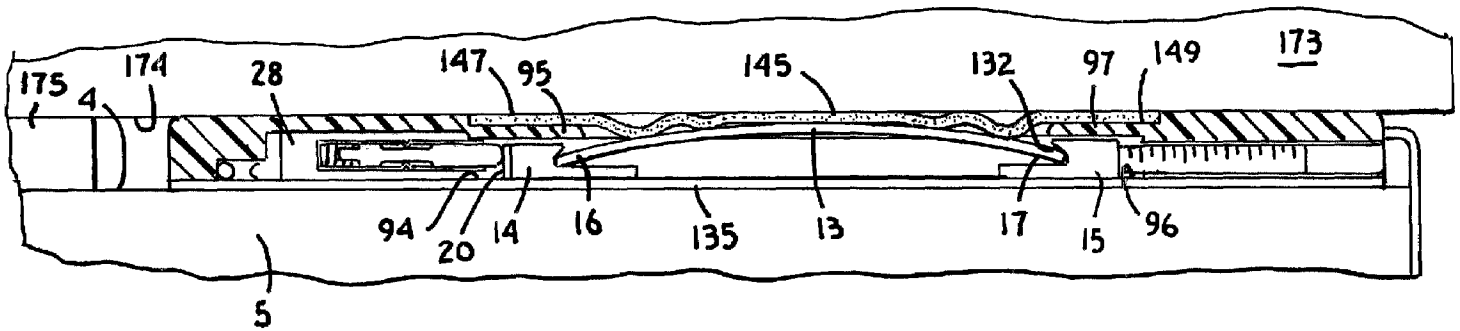
FIG. 4 is a view similar to FIG. 3 showing the ejector plate advanced into engaging relation with and compressing a bowed spring actuating mechanism of the limit switch assembly to advance a bridge contact connected to the bowed spring into engagement with a pair of terminal contacts.
Figure 5:
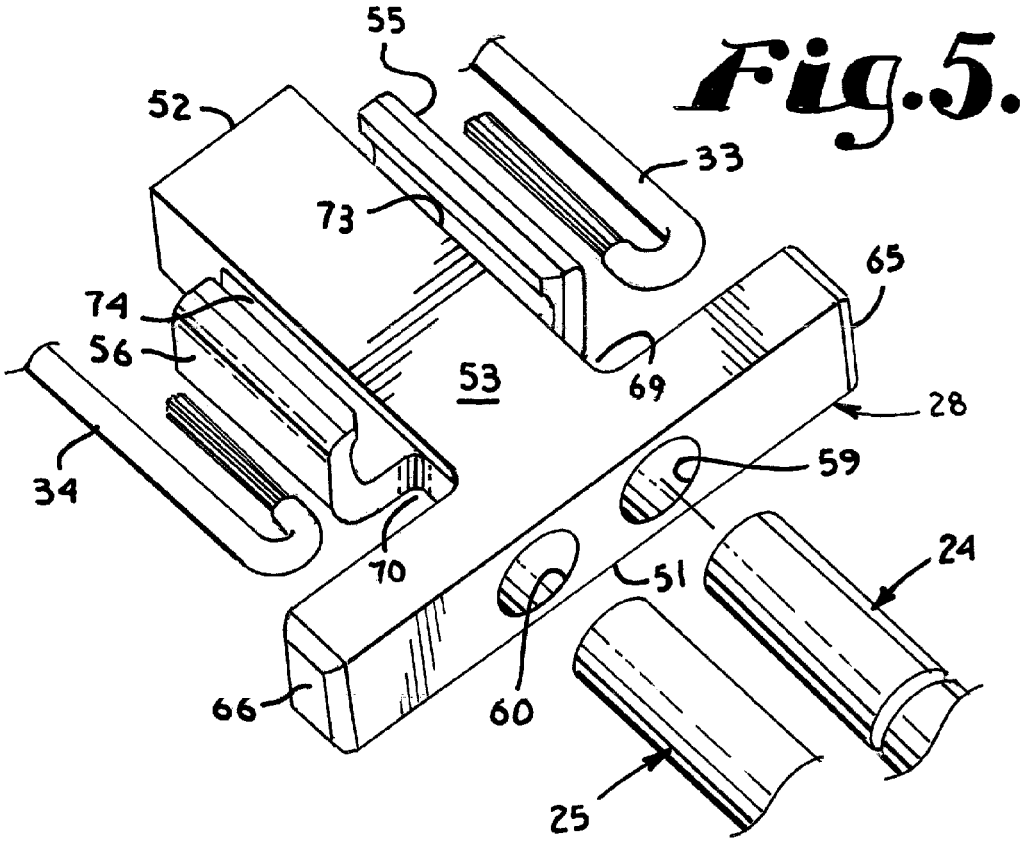
FIG. 5 is an enlarged, fragmentary and exploded perspective view showing the terminal contacts, electrical conductors and a terminal connector block, the terminal connector block holding the terminal contacts and the conductors in electrical contact within a housing for the limit switch assembly.

Referring to the drawings in more detail, the reference numeral 1 refers to a low-profile switch assembly. As used herein, the front of the switch assembly 1 is shown to the left hand side in FIG. 2. The switch assembly 1 is shown in FIG. 1 mounted to an inner surface 4 of a mold ejector housing 5 by a mounting clip 8. As shown in FIGS. 2-6, the low-profile switch assembly 1 includes a switch housing 11, a leaf spring or bowed spring 13 with first and second glides 14 and 15 mounted on or connected to first and second ends 16 and 17 respectively of the bowed spring 13, an electrically conductive bridge contact 20 mounted on an outer face 21 of the first glide 14, and first and second terminal contacts 24 and 25 mounted within a terminal connector block 28. As will be discussed in more detail hereafter and as best seen in FIGS. 2 and 5, the terminal connector block 28 is mounted within the housing 11 such that distal ends of the terminal contacts 24 and 25 extend in closely spaced relation to the bridge contact 20 on the first glide 14.

Power is supplied to the switch assembly by a power supply cable 32, which preferably comprises a shielded cable with a drain ground. The power supply cable 32 is shown exiting the housing 11 to the rear thereof in FIGS. 1 and 2. The power supply cable 32 includes first and second conductors or leads 33 and 34 and is connected to and extends into the housing 11 with the first and second conductors 33 and 34 connected at first ends thereof to the first and second terminals 24 and 25 respectively in the terminal connector block 28. The cable 32 is connected at second ends of the first and second conductors 33 and 34 to a processor or the like (not shown) for receiving signals from the switch assembly 1 indicative of whether the switch assembly 1 is in an open (off) or closed (on) condition.

The first and second terminal contacts 24 and 25 are electrically conductive and in the embodiment shown comprise spring contact probes. An example of a spring contact probe which is particularly well adapted for use as the terminal contacts 24 and 25 of the switch assembly 1 is an SS-100/GSS-100 probe sold by Interconnect Devices, Inc. utilizing a tip style number 10, which generally comprises a hemispherical tip.

Each spring contact probe utilized as the terminal contacts 24 and 25 includes a barrel 38, a plunger 39 and a compression spring 40. Each barrel 38 is cylindrical with an open end 42, a closed end 43 and an internal shoulder 44 formed by crimping the barrel 38 generally medially along its axis. Each plunger 39 includes a head 46 with a tip or distal end 47, a shaft 48 of reduced diameter and a base or tail end 49 generally equivalent in diameter with the head 46. The plunger 39 is mounted within the barrel 38 with the base 49 positioned between the closed end 43 and the shoulder 44 and with the compression spring 40 abutting at one end against the closed end 43 of the barrel 38 and at an opposite end against the plunger base 49. The outer diameter of the plunger base 49 is larger in diameter than the plunger shaft 48 and larger than the inner diameter of the internal shoulder 44 to prevent the plunger from being urged completely out of the barrel 38. The spring 40 engages and normally urges the plunger 39 outward relative to the barrel 38 (rearward relative to the switch assembly housing 11) to an extended position. The plunger 39 is compressible to a compressed position relative to the barrel and against the biasing force of the compression spring 40. All of the components of the terminal contacts 24 and 25 are preferably formed from electrically conductive material such that the terminal contacts 24 and 25 are electrically conductive.

The terminal connector block 28 is preferably formed from plastic or other non-conductive materials. The block 28 functions to hold the terminal contacts 24 and 25 in the desired alignment relative to one another and relative to the bridge contact 20. The terminal connector block 28 also facilitates holding the exposed ends of the first and second conductors 33 and 34 in electrically conductive contact with the terminal contacts 24 and 25. As generally shown in FIG. 7, the conductors 33 and 34 may comprise multi-strand wire such as copper wire. The block 28 may be described as having a rear 51, front 52, top 53, bottom 54 and sides 55 and 56. First and second bores 59 and 60 extend into the block 28 from the rear 51 toward the front 52 in spaced relation on opposite sides of an axis of the block 28 with first and second stops 62 and 63 formed at the end of bores 59 and 60 respectively. The first bore 59 extends into the block 28 to a greater depth than the second bore 60, such that stop 62 is spaced further forward from the block rear 51 than the stop 63.

In the disclosed embodiment, first and second mounting arms 65 and 66 project laterally outward from the first and second sides 55 and 56 of the block 28. The arms 65 and 66 are adapted for securing the block 28 within the housing and restricting axial movement of the block 28 relative thereto as described in more detail hereafter. First and second notches 69 and 70 extend into the sides 55 and 56 respectively of the block 28, generally adjacent the first and second mounting arms 65 and 66 and open into the axial bores 59 and 60.

First and second grooves 73 and 74 extend into the block 28 from the top or upper surface 53 and opening into the first and second bores 59 and 60 respectively generally along the axis of each bore 59 and 60. Each groove 73 and 74 intersects with and extends from the respective notch 69 and 70 to the stops 62 and 63 at the end of each bore 59 and 60. The grooves 73 and 74 generally function as expansion joints and create block sidewalls 77 and 78 which flex or expand outward to allow expansion of the size of the axial bores 59 and 69 and thereby accommodate the volume of both the respective terminal contact 24 and 25 and the associated conductor 33 and 34. The notches 69 and 70 facilitate insertion of the stripped ends of the conductors 33 and 34 into the respective axial bores 59 and 60, prior to insertion of the terminal contacts 24 and 25 therein. Due to the resilient nature of the plastic forming the terminal connector block 28, the block sidewalls 77 and 78 generally compress against the respective conductors 33 and 34 and the terminal contacts 24 and 25 to ensure electrical connection therebetween.

The terminal contacts 24 and 25 are fully inserted into the block 28, such that the closed end 43 of the barrel 38 of each contact 24 and 25 abuts against a respective stop 62 and 63. Because the first stop 62 in block 28 is positioned further into the block 28 or forward of the second stop 63, the tip 47 of the plunger 39 of the second terminal contact 25 projects further outward or rearward from the terminal connector block 28 than the tip 47 of the plunger 39 of the first terminal contact 25. It is foreseen that structure for holding the terminal contacts 24 and 25 and the conductors 33 and 34 in the proper alignment and in electrical contact could be molded or otherwise formed directly in the switch housing 11 and not as a separate piece.

The switch housing 11 is preferably formed from a relatively hard, rigid material such as a hard plastic. The housing 11 includes an upper surface 81 and a lower surface 82. As is best seen in FIGS. 3 and 4, the distance between the upper surface 81 and the lower surface 82 of the housing 11 is preferably only slightly greater than the thickness of the terminal connector block 28. A terminal receiving cavity 83 is formed in the housing 11 and extends from the lower surface 82 toward the upper surface 81 thereof. The terminal receiving cavity 83 includes a central portion 84 and first and second slots 85 and 86 projecting sideways or outward from the main portion 84 on opposite sides thereof. The terminal receiving cavity 83 is sized to receive the terminal connector block 28 with the first and second mounting arms 65 and 66 extending into the first and second slots 85 and 86 respectively to fix the axial position of the terminal connector block 28 within the housing 11. The terminal connector block 28 is secured in the cavity 83 such that the axis of the plungers 39 of each terminal contact 24 and 25 extends in parallel relation with the upper and lower surfaces 81 and 82 of the switch assembly housing 11.

A circular recess 90 (seen in cross-section in FIGS. 3 and 4) extends into the housing 11 from the upper surface 81 toward the lower surface 82. A spring receiving channel, slot or opening 92 is formed in and extends into the housing 11 from the lower surface 82 toward the upper surface 81. The spring receiving slot 92 is preferably rectangular and extends across the circular recess 90 coaxially with the axis of the terminal connector block 28. A first end 93 of the slot 92 connects to and opens into the terminal receiving cavity 83 such that the plungers 39 of the first and second terminal contacts 24 and 25 extend into the slot 92. In addition, the slot 92, near its first end 94 does not extend completely through the housing 11 such that a portion of the housing 11 extends over the slot 92 at the slot first end 94 to form a first overhang 95. Similarly, the slot 92, near a second end 96 thereof, does not extend completely through the housing 11 such that a portion of the housing 11 extends over the slot 92 at the slot second end 96 to form a second overhang 97.

A wiring channel 100 is also formed in the housing 11 so as to extend from the lower surface 82 and toward but not completely to the upper surface 81 of the housing 11. A first end 101 of the channel 100 opens into the terminal receiving cavity 83 at an end of the cavity 83 opposite the spring receiving channel 92. A second end 102 of the wiring channel 100, extends out of a side or edge of the 103 of the housing 11. The first end of the power supply cable 32 including the first and second conductors 33 and 34 is secured in the wiring channel 100. The side or position on the edge of the housing 11 to which the power supply cable 32 needs to be routed may vary depending on the particular application sought and therefore the routing of the channel 100 may vary. A waterproof or water resistant sealing compound or potting compound (not shown) may be injected into the wiring channel 100 to form a water-tight seal around the wiring 100.

The leaf spring or bowed spring 13 is secured within the spring receiving slot 92 and functions as an actuator for the switch. As discussed previously, the spring 13 includes a first spring end 16 with a first glide or shoe 14 mounted thereon, and a second spring end 17 with a second glide or shoe 15 mounted thereon. In its resting state, the spring 13 is bowed and the middle portion of the spring 13 is identified by the reference numeral 113.

Referring to FIGS. 3 and 4, each glide 14 and 15 includes an outer face 21, an inner end 122, an upper surface 123 and a bottom surface 126. A notch or groove 128 extends into each glide 14 and 15 from the inner end 122 thereof from side to side and is sized and shaped for receiving the first or second spring end 16 or 17 of spring 13. An inwardly projecting overhang or upper flange 130 is formed in the glides 14 and 15 above the notch 128 and an inwardly projecting tail or lower flange 131 is formed in the glides 14 and 15 below the notch 128. The upper flange 130 is preferably shorter than the lower flange 131 and includes an angled or beveled lower surface 132 to accommodate the bow of the spring 13 (as best seen in FIGS. 3 and 4). The glides 14 and 15 are preferably formed from material exhibiting a relatively low coefficient of friction and which functions as an electrical insulator, such as plastic resin sold under the trademark Delrin.

The bridge contact 20 is secured to the first glide 14 in a recess 133 formed in the outer face 21 of the first glide 14 such that an outer surface 134 of the bridge contact 20 is exposed to and faces the first and second terminal contacts 24 and 25. Sides of the recess 133 may be undercut to form overhanging edges along the sides of the recess for holding the bridge contact 20 in place. The bridge contact 20 is formed from electrically conductive material, such as copper and may be mechanically or adhesively secured to the glide 14 or possibly molded in place. The bridge contact 20 is sized to be slightly wider than the spacing of the two terminal contacts 24 and 25 and slightly taller than the diameter of each terminal contact 24 and 25, such that when the bridge contact 20 is brought into engagement with the terminal contacts 24 and 25 as discussed below, the bridge contact 20 electrically connects the first terminal contact 24 to the second terminal contact 25.

The terminal connector block 28 with terminal contacts 24 and 25 mounted therein, the spring 13, glides 14 and 15 and power supply cable 32 are held within the housing 11 by a backing or backing sheet 135. The backing 135 is formed from a layer of relatively thin material, such as a relatively rigid polyester plastic sheet. The relative thickness of the backing sheet 135 shown in the drawings is exaggerated to make the backing sheet 135 readily discernable. The backing 135 is secured to the lower surface 82 of the housing 11 by securement means such as an adhesive. The backing 135 extends across the terminal receiving cavity 83, the spring receiving slot 92 and the wiring channel 100 to secure the terminal connector block 28 with terminal contacts 24 and 25 mounted therein, the spring 13, glides 14 and 15 and power supply cable 32 respectively therein.

The glides 14 and 15 slide across the backing sheet 75 upon compression and subsequent release of the spring 13 as discussed in more detail below. Adhesive is selectively omitted from the backing 135 in the area in which the glides 14 and 15 will slide across the backing 135 to ensure proper functioning of the switch assembly 1. Potting compound may be injected into the wiring channel 100 after the backing sheet 135 is secured to the housing 11.

The spring 13 is positioned within the slot 92 of the housing 11 in the resting state, such that the middle portion 113 of the spring 13 extends through the circular recess 90 and bows above the upper surface 41 of the housing 11. The first glide 14 is generally positioned beneath the first overhang 95 and the second glide 15 is generally positioned beneath the second overhang 97. The distance between the upper surface of the backing 135 and the lower surface of the first and second overhangs 95 and 97 is just slightly greater than the thickness of the glides 14 and 15 such that the glides 14 and 15 are allowed to slide therebetween without binding.

The spring 13 is sized such that when it is positioned in the slot 92, the bridge contact 20 on the outer face 21 of the first glide 14 is positioned in closely spaced relation to the tip 47 of the extended plunger 39 of the second terminal contact 25, and the outer face 21 of the second glide 15 is positioned in closely spaced relation to an inner wall 138 of the housing 11 at the slot second end 96. As used in the preceding description, the phrase "in closely spaced relation" is intended to mean in actual engagement or positioned slightly apart. Because the tip 47 of the extended plunger 39 of the second terminal contact 24 is offset rearward from the tip 47 of the extended plunger 39 of the first terminal contact 25, the bridge contact 20 is maintained in spaced relation from the plunger tip 47 of the first terminal contact 24 when the bowed leaf spring 13 is in an uncompressed condition. In this condition, the switch assembly 1 is in an open condition, preventing the flow of electricity therethrough.

The overall length of the spring receiving channel or slot 92 is greater than the distance between the outer faces 21 of the first and second glides 14 and 15 when the spring 13 is in an uncompressed state, such that the spring force exerted by the compression spring 40 in the second terminal contact 25 is sufficient to maintain space between the bridge contact and the plunger tip 47 of the first terminal contact 24.

A set screw 140 is threaded into a threaded bore 141 formed in the switch housing 11 and extending from an edge 143 of the housing 11 to the second end 96 of spring receiving slot 92, through inner wall 138. The inner end of the set screw 140 may be advanced past the inner wall 138 and into the spring receiving slot 92 a selected distance to reduce the effective length of the spring receiving slot 92, thereby reducing the required distance to be traveled by the first glide 14 to depress the plunger 39 of the second terminal contact 25 and advance the bridge contact 20 into contact with both the first and second terminal contacts 24 and 25 to change the condition of the switch assembly to closed. When the inner end of the set screw 140 is extended through inner wall 138 and into spring receiving slot 92, the outer face 21 of second glide 15 engages the set screw 140, at least when the spring 13 is depressed. Prior to depression of the spring 13 the outer face 21 of second glide 15 is positioned in closely spaced relation with the inner end of the set screw 140. A thread sealing compound is preferably applied to the set screw 140 prior to threading the set screw 140 into the threaded bore 141 to form a water tight seal between the set screw 140 and threaded bore 141.

Figure 6:
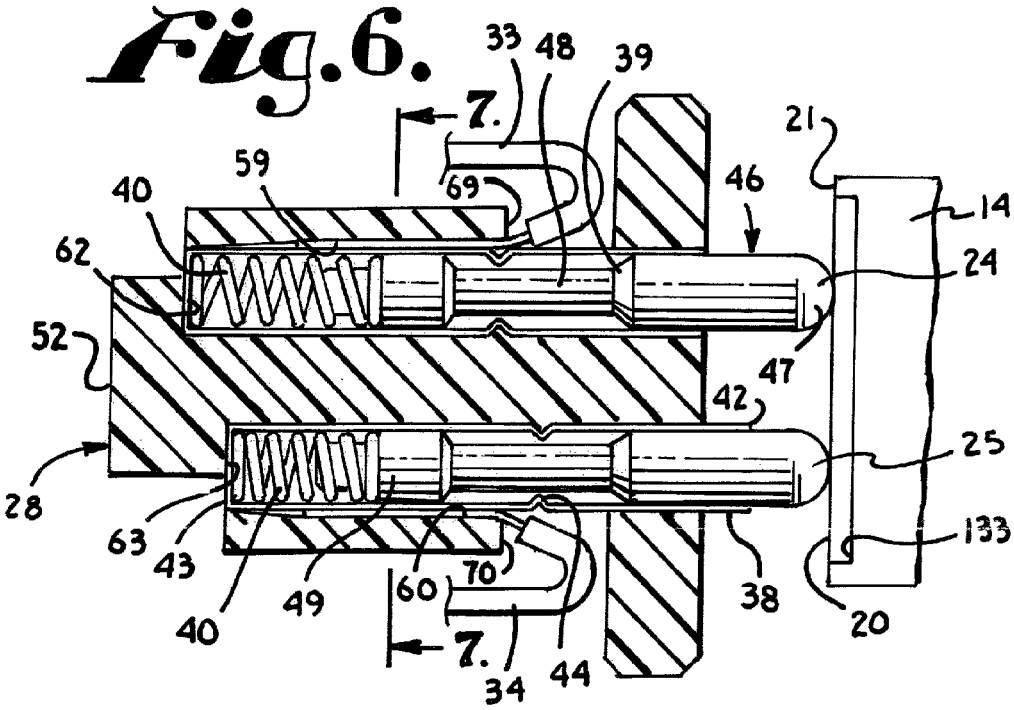
FIG. 6 is an enlarged and fragmentary cross-sectional view taken generally along line 6-6 of FIG. 4 showing the terminal contacts and the conductors mounted within the terminal connector block with the bridge contact engaging and compressing plungers of the terminal contacts.

As is best seen in FIG. 4, application of a force to the middle portion 113 of the spring 13 and toward the upper surface 81 of the housing 11 compresses the spring 13 such that the first glide 14 on first spring end 16 advances further away from the second glide 15 on second spring end 17 and toward the first and second terminal contacts 24 and 25. If not already in contact, the bridge contact 20 is first advanced into contact with the plunger tip 47 of the second terminal contact 25, compressing the second terminal contact plunger 39 against the force of compression spring 40 until the bridge contact 20 is advanced into contact with the plunger tip 47 of the first terminal contact 24. As best seen in FIG. 6, the first glide 14 and bridge contact 20 preferably are driven far enough toward the terminal connector block 28 upon compression of leaf spring 13, such that the bridge contact 20 engages and compresses the plungers 39 of both the first and second terminal contacts 24 and 25 to ensure electrical contact therebetween to complete the circuit and change the condition of the switch assembly to closed or on. The spring 13 may be described as translating a force applied perpendicularly to the axis of the terminal contact plungers 39, to a force applied coaxially with the plungers 39. As the spring 13 is compressed, the first and second spring ends 11 and 17 are driven into a lower corner in the groove or notch 128 in the respective glide 14 and 15.

Removal of the force applied to the middle portion 113 of the leaf spring 13 allows the leaf spring 13 to return to the resting state such that the first spring end 16 and the attached glide 14 including the bridge contact 20, advance away from the plungers 39 of the first and second terminal contacts 24 and 25 allowing the plungers 39 to be biased to their extended positions by the compression springs 40 in each terminal contact 24 and 25. Because the second terminal contact 25 is spaced or offset rearward from the first terminal contact 24, the spring force exerted by compression spring 40 against the plunger 39 of the second terminal contact 25 ensures that the bridge contact 20 is advanced out of engagement with the first terminal contact 24 when the leaf spring 13 is allowed to return to its resting state thereby ensuring breaking of the electrical circuit and changing the condition of the switch assembly 1 to an open or off condition.

Although the glides 14 and 15 are generally only loosely connected to the first and second spring ends 16 and 17, the downwardly and inwardly directed force exerted by the spring ends 16 and 17 on the inwardly projecting lower flange 131 of the respective glide 14 and 15 may be sufficient to pull the glides 14 and 15 away from the plungers 39 of the terminal contacts 24 and 25 and away from set screw 140 respectively. It is also foreseen that the first glide 14 may only retract the distance that it is pushed rearward by the plunger 39 of the second terminal contact 25 once the force is removed from the middle portion 113 of spring 13, and the spring ends 16 and 17 will then slide inward along the upper surface of the associated lower flange 131 of each glide 14 and 15. The lower flange 131 of each glide 14 and 15 is sufficiently long and the distance between the opposed lower flanges 131 when the glides 14 and 15 are separated their furthest distance apart is sufficiently small to prevent either spring end 16 or 17 from sliding off of either of the associated lower flanges 21 when the leaf spring 13 advances to the resting, uncompressed position. It is also to be understood that the glides 14 and 15 could be fixedly secured to the spring ends 16 and 17 by a wide variety of means including adhesives or mechanical connections.

A flexible seal or sealing member 145 is mounted on the upper surface 81 of the housing 11 over the leaf spring 13 and the circular recess 90. The flexible seal 145 preferably is dome shaped or hemispherical with a peripheral flange 147 for securing the seal 145 to the housing 11 in a flange receiving recess 149 formed in the upper surface 81 of the housing 11. The flange receiving recess 149 is formed around the periphery of the circular recess 90, and the depth of the flange receiving recess 149 generally corresponds to the thickness of the peripheral flange 147 of the seal 145 so that the upper surface of the flange 147 extends flush with the upper surface 81 of the housing 11. The flexible seal may be formed from a polyurethane, thermoset film approximately 5 to 10 mils thick. The flange 147 of seal 145 may be secured to the housing by a urethane pressure sensitive adhesive. A circular, flattened area (not shown) may be formed in the seal 145 around its apex.

When the seal 145 and spring 13 are compressed by advancement of a machine part or other surface against the seal 145 and the spring 13, the excess material of the seal 145 is forced into the circular recess 90. The semi-spherical shape of the seal 145 and the round shape of the circular recess 90 provide a relatively large area for receiving or taking up the excess material of the seal 145 as it is forced downward or inward by advancement of a surface against the seal 145. The semi-spherical shape of the seal 145 is also believed to result in less stress to the polyurethane material, increasing the life of the seal.

The flexible seal 145, the potting compound injected around the power supply cable 32 and the sealing compound applied to the set screw 140 function to form a water tight or liquid resistant seal around the terminal contacts 24 and 25 and the bridge contact 20, and the electrical connections between the terminal contacts 24 and 25 and the first and second conductors 33 and 34. The water resistant switch assembly 1 is particularly adapted for use in applications in which the actuating mechanism may be routinely exposed to water or other liquids.

As with the switch assemblies disclosed in U.S. Pat. Nos. 5,446,252 and 6,982,392, the switch assembly 1, disclosed herein, is securable to various structural members by securement means such as adhesives or bolting. Referring to FIGS. 2 and 7, bores 152 are formed in the housing 11 through which screws or bolts (not shown) may be driven for securing the housing 11 to a structure such as the mold ejector housing 5 shown in FIG. 1.

Alternatively, a variety of clips or mounting brackets such as the mounting clip 8, as shown in FIGS. 1 and 8 may be used to secure the switch assembly 1 to a surface such as inner surface 4 of a mold ejector housing 5. The clip 8 is preferably formed from spring steel (but could be molded from flexible plastic) and includes a mounting flange 155 and first and second spring arms 157 and 158 projecting away from the mounting flange 155 generally at an angle of slightly less than 90 degrees relative thereto such that the spring arms angle downward from the mounting flange 155 to distal ends thereof. The mounting flange 155 includes bolt holes (not shown) through which bolts 159 may be driven to mount the clip 8 to a side edge or surface 160 of the structure to which the switch assembly 1 is to be mounted, such as the mold ejector housing 5. The distal ends of the spring arms 157 and 158 extend below an upper edge of the mounting flange 155.

The distal ends of the spring arms 157 and 158 curve inward to form an inwardly directed detent or tongue 161 on the end of each arm 157 and 158. A downwardly projecting dimple 163 is formed in each tongue 161. The dimples 163, which may also be referred to as indentations or bosses, are sized to be matingly received in first and second recesses 165 formed in first and second wings 167 forming part of the switch housing 11. The wings 167 may also be referred to as ears or tabs and project outward from a main portion of the housing 11, generally on opposite sides of an axis running through the spring receiving slot 92 and generally medially relative to the length of the housing 11. The bores 152 for mounting the housing 11 using bolts or the like as discussed previously are also formed in the wings 167 and generally extend in alignment with the recesses 165. A leading edge 169 of each wing 167 projects forward toward a front of the housing 11 and presents an upwardly and rearwardly sloped surface.

The spring arms 157 and 158 of the mounting clip 8 are spaced apart a distance which permits the switch housing 11 to be slid therebetween. The first and second detents 161 are positioned by the spring arms 157 and 158 to engage the wings 167 of the switch housing 11 as it is slid between the arms 157 and 158. The downwardly projecting dimples 163 on each detent 161 engage a leading edge 169 of the associated wings 167, biasing the detents 161, and the spring arms 157 or 158 to which they are attached, upward until the dimple 163 passes up and over the front of the respective wing 167 and then drops into the recess 165 therein to form a mechanical connection between the clip 8 and the housing 11 to secure the housing 11 to the mold ejector housing 5 or other structure with which it is to be used.

FIGS. 3 and 4 are representative of one use of the actuating mechanism 1 of the present invention in an injection molding application, mentioned above and described in more detail in U.S. Pat. No. 5,446,252. Referring to FIGS. 3 and 4 of the present application, the reference numeral 173 is representative of an ejector plate advanceable between an ejecting position (represented by FIG. 3) and a retracted position (represented by FIG. 4) by means not shown. In the retracted position, a lower surface 174 of the ejector plate 173 engages stops or rest buttons 175 (one of which is shown in FIGS. 3 and 4) positioned on and extending above the inner surface 4 of the ejector housing 5.

The switch assembly 1, is used to verify that the ejector plate 173 has returned to the retracted position. The actuating mechanism 1 is sized to have a relatively narrow profile such that the housing 11 and backing sheet 135 are approximately the same thickness or height as and preferably no taller than the thickness of the rest buttons 175 and the upper surface 81 of the housing 11 extends generally flush with upper surfaces of the rest buttons 175. The middle portion 113 of the spring 13, when not engaged, extends above the upper surface 81 of the housing 11 and above the upper surfaces of the rest buttons 175. As the ejector plate 173 is advanced to a retracted position, the lower surface 176 of the ejector plate 173 engages the seal 145 and compresses the spring 13, advancing the first spring end 16 and first glide 14 with the bridge contact 20 mounted thereon toward and into contact with the first and second terminal contacts 24 and 25 so as to change the condition of the switch assembly 1 from an open condition to a closed condition and send a signal indicating that the ejector plate 173 has returned to the retracted position.

Because the mounting clip 8 can be bolted to the side of a mold ejector housing 5, the switch assembly can be attached to the mold ejector housing 5 without first having to remove the ejector plate 173 from the mold to provide access to otherwise bolt the switch housing 11 to the upper or inner surface 4 of the mold ejector housing 5. The mold operator can thereby avoid unnecessary downtime or labor in having to disassemble the mold.

It is to be understood that while certain forms of the present invention have been illustrated and described herein, it is not to be limited to the specific forms or arrangement of parts described and shown.

For example, it is foreseen that the switch assembly 1 of the present invention has numerous applications beyond the injection molding application discussed above and its use is not intended to be limited to such applications. Similarly it is foreseen that the mounting clip 8 can be utilized to mount devices other than the disclosed switch assembly to a wide variety of surfaces. However a preferred application of the clip 8 is to mount limit switches or the like on one of a stationary member and a moveable member, such as the ejector housing 5 and an ejector plate 173 of an injection mold, to determine the relative position of the moveable member relative to the stationary member.

It is also foreseen that the terminal contacts 24 and 25 could be mounted between the first and second spring ends 16 and 17 and facing the outward toward the first spring end 16 with the bridge contact 20 mounted on an inner face of the first glide 14 mounted on the first spring end 16. In such an embodiment the application of a force to the middle portion 113 of the spring 13 to cause the spring 13 to bow advances the first spring end 16, first glide 14 and bridge contact 20 away from the terminal contacts 24 and 25 a distance sufficient to draw the bridge contact 20 out of engagement with at least one of the terminal contacts 24 and 25 to change the condition of the switch from normally closed (on) to open (off). Release of the force, then allows the spring 13 to advance back to the resting position so as to allow the first spring end 16, glide 14 and bridge contact 20 to advance toward and into contact with both terminal contacts 24 and 25 to change the switch condition back to closed.

It is foreseen that the first glide 14 could be formed from electrically conductive material such that the glide 14 itself, including an outer face 21, functions as the bridge contact for completing an electrical connection between the first and second terminal contacts 24 and 25. It is also foreseen that instead of having a glide 14 connected to the first end 16 of the spring 13, the first end of the spring 13 could be utilized as the bridge contact 20, for example, the first end 16 of the spring could be turned upward to form a foot (as shown in U.S. Pat. No. 5,446,252) to present a metallic surface for contacting and forming an electrical connection between the terminal contacts 24 and 25. The flexible seal 145, formed from an electrical insulating material, would prevent shorts of the switch assembly 1 through the spring 13 as long as the seal 145 does not tear or otherwise expose the spring 13.

As used herein and in the claims, reference to the bridge contact being connected to the bowed spring or first end thereof is intended to include the alternative embodiments described above and any other embodiment in which the bridge contact is formed as part of the spring itself or formed separately and connected to the spring either directly or indirectly. Moreover, the terms connected to or connect are intended to include both direct and indirect connections (i.e. connection through intervening parts) unless clearly specified otherwise.

What is claimed is:

1. A low profile switch comprising:

a) a housing having an upper surface;

b) first and second electrically conductive terminal contacts electrically connected to first and second conductors respectively; said first and second terminal contacts mounted within said housing in spaced relation;

c) a bowed spring having a first spring end, a second spring end and a middle portion; an electrically conductive bridge contact on a foot on said first spring end, said bowed spring being positioned within said housing such that said bridge contact is positioned proximate said first and second terminal contacts; said middle portion of said bowed spring bowing above said housing upper surface through a spring receiving opening in said housing such that the application of a force to said middle portion of said bowed spring and directed toward said housing upper surface compresses said bowed spring, advancing said first spring end and said bridge contact relative to said first and second terminal contacts changing the condition of said switch from a first condition to a second condition and upon removal of the force said first spring end and said bridge contact advance an opposite direction relative to said first and second terminal contacts changing the condition of said switch from the second condition to a first condition.

2. The low profile switch as in claim 1 wherein said first terminal contact is formed from a spring probe and said first and second terminal contacts are positioned in said housing such that when said bridge contact is advanced away from said first and second terminal contacts a distal end of said first terminal contact extends closer to the bridge contact than said second terminal contact.

3. The low profile switch as in claim 2 wherein said second terminal contact is formed from a spring probe.

4. A low profile switch comprising:

a) a housing having an upper surface;

b) first and second electrically conductive terminal contacts electrically connected to first and second conductors respectively; said first and second terminal contacts mounted within said housing in spaced relation;

c) a bowed spring having a first spring end, a second spring end and a middle portion; said first spring end supported on a glide having an electrically conductive bridge contact mounted on said glide, said bowed spring being positioned within said housing such that said bridge contact is positioned proximate said first and second terminal contacts; said middle portion of said bowed spring bowing above said housing upper surface through a spring receiving opening in said housing such that the application of a force to said middle portion of said bowed spring and directed toward said housing upper surface compresses said bowed spring, advancing said first spring end toward said first and second terminal contacts to advance said bridge contact into engagement with both of said first and second terminal contacts to create an electrical connection between said first and second terminal contacts and through said bridge contact; and upon removal of the force said first spring end advances away from the first and second terminal contacts a distance sufficient to advance the bridge contact out of engagement with at least one of said first and second terminal contacts to break the electrical connection between said first and second terminal contacts through said bridge contact.

5. The switch as in claim 4 wherein said first terminal contact includes a first electrically conductive spring biased plunger positioned relative to said second terminal contact such that when said first spring biased plunger is biased outward to an extended position, a distal end of said first spring biased plunger extends closer to said bridge contact than a distal end of said second terminal contact, said first spring biased plunger compressible to a retracted position upon engagement with said bridge contact wherein said bridge contact is also in contact with said second terminal contact.

6. The switch as in claim 5 wherein said second terminal contact includes a second electrically conductive spring biased plunger.

7. The switch as in claim 4 wherein said first glide is made of an electrical insulating material and said bridge contact is mounted on an outer face of said first glide.

8. The switch as in claim 7 further comprising a backing secured to and extending at least partially across a lower surface of said housing to cover said spring, said first and second terminal contacts and said first glide.

9. The switch as in claim 4 in combination with a mounting clip for mounting said switch to a first surface of a structural member having a second surface extending perpendicular to said first surface wherein said housing of said switch includes a pair of tabs projecting outward therefrom with a recess formed in an upper surface of each of said tabs and a leading edge of each of said tabs sloping upward toward said recess; said mounting clip includes a mounting flange adapted to be mounted on said second surface of said structural member; said mounting clip further including first and second spring arms projecting outward from an upper edge of said mounting flange at an angle of less than ninety degrees relative thereto; each of said arms having an inwardly projecting detent formed thereon with a dimple formed in said detent, said arms spaced apart a distance sufficient to allow a front of said switch housing to be advanced between said arms until said leading edges of said tabs engage and pass under said dimples on said first and second arms and then drop into said recesses formed in said tabs, such that said arms biasingly hold said switch housing against said first surface of the structural member.

10. The low profile switch as in claim 4 wherein said first terminal contact is formed from a spring probe and said first and second terminal contacts are positioned in said housing such that when said bridge contact is advanced away from said first and second terminal contacts a distal end of said first terminal contact extends closer to the bridge contact than said second terminal contact.

11. The low profile switch as in claim 10 wherein said second terminal contact is formed from a spring probe.

12. A mounting clip in combination with a limit switch adapted to determine the position of a first member relative to a second member, said mounting clip adapted for mounting the switch assembly to a first surface of the first member proximate an edge of said first member extending perpendicular to said first surface; said switch having a housing with upper and lower surfaces and a switch actuator extending above an upper surface of said housing, wherein compression of the actuator through advancement of said second member into engagement or close proximity therewith changes the condition of the switch from a first condition to a second condition; said switch housing includes a pair of recesses formed in an upper surface thereof proximate a forward facing edge of said housing, said forward facing edge sloping upward toward said recesses; said mounting clip includes a mounting flange adapted to be mounted on said edge of said first member; said mounting clip further including first and second spring arms projecting outward from an upper edge of said mounting flange at an angle of approximately ninety degrees or less relative thereto; each of said spring arms having a detent formed thereon proximate a distal end thereof, each of said detents including a downwardly projecting boss, said arms being spaced apart a distance sufficient to allow a front of said switch housing to be advanced between said arms until said leading edges of said housing proximate said recess engage and pass under said bosses on said first and second detents until said bosses are urged into said recesses aligned therebelow, such that said arms biasingly hold said switch housing against said first surface of the first member.

13. The combination switch housing and mounting clip of claim 12 wherein bolt holes extend through said housing in axial alignment with said recesses formed therein.

14. The combination switch housing and mounting clip of claim 12 wherein said mounting clip is formed from spring steel.

15. A low profile switch comprising:

a) a housing having an upper surface;

b) first and second electrically conductive terminal contacts electrically connected to first and second conductors respectively; said first and second terminal contacts mounted within said housing in spaced relation;

c) a bowed spring having a first spring end, a second spring end and a middle portion;

d) a glide made of an electrical insulating material and mounted on said first spring end;

e) an electrically conductive bridge contact mounted on a face of said glide;

f) said bowed spring positioned within said housing such that said bridge contact is positioned proximate said first and second terminal contacts; said middle portion of said bowed spring bowing above said housing upper surface through a spring receiving opening in said housing such that the application of a force to said middle portion of said bowed spring and directed toward said housing upper surface compresses said bowed spring, advancing said spring end and said first glide toward said first and second terminal contacts to advance said bridge contact into engagement with both of said first and second terminal contacts; and upon removal of the force said first spring end drawing said first glide away from said first and second terminal contacts a distance sufficient to draw the bridge contact out of engagement with at least one of said first and second terminal contacts.

16. The low profile switch as in claim 15 wherein said first terminal contact is formed from a spring probe and said first and second terminal contacts are positioned in said housing such that when said bridge contact is advanced away from said first and second terminal contacts a distal end of said first terminal contact extends closer to the bridge contact than said second terminal contact.

17. The low profile switch as in claim 16 wherein said second terminal contact is formed from a spring probe.

* * * * *